US009868069B2

(12) United States Patent
Keller

(10) Patent No.: US 9,868,069 B2
(45) Date of Patent: Jan. 16, 2018

(54) ROTATING CLIMBING UNIT

(71) Applicant: Landscape Structures Inc., Delano, MN (US)

(72) Inventor: Thomas L. Keller, Delano, MN (US)

(73) Assignee: Landscape Structures Inc., Delano, MN (US)

( * ) Notice: Subject to any disclaimer, the term of this patent is extended or adjusted under 35 U.S.C. 154(b) by 0 days.

(21) Appl. No.: 15/359,794

(22) Filed: Nov. 23, 2016

(65) Prior Publication Data

US 2017/0165583 A1 Jun. 15, 2017

Related U.S. Application Data

(60) Provisional application No. 62/265,559, filed on Dec. 10, 2015.

(51) Int. Cl.

| | |
|---|---|
| ***A63G 1/08*** | (2006.01) |
| ***A63G 1/12*** | (2006.01) |
| ***A63B 9/00*** | (2006.01) |
| *A63G 9/00* | (2006.01) |

(52) U.S. Cl.
CPC ..... *A63G 1/12* (2013.01); *A63B 9/00* (2013.01); *A63B 2009/006* (2013.01)

(58) Field of Classification Search
CPC ... A63G 1/00; A63G 1/08; A63G 1/10; A63G 13/00; A63G 27/00
USPC ..... 472/29, 32, 33, 36, 43; 482/33, 35
See application file for complete search history.

(56) References Cited

U.S. PATENT DOCUMENTS

| | | | | |
|---|---|---|---|---|
| 3,073,595 | A | 1/1963 | Jones | |
| 3,210,075 | A | 10/1965 | Brookman et al. | |
| 3,612,518 | A | 10/1971 | Bennett | |
| 3,698,710 | A | 10/1972 | Schwarzkopf | |
| 4,728,098 | A | 3/1988 | Shannon | |
| 4,877,236 | A | 10/1989 | Shannon | |
| 4,982,949 | A | 1/1991 | Ulferts | |
| 5,709,606 | A * | 1/1998 | Ehrman | A63G 1/28 472/119 |
| 5,795,235 | A | 8/1998 | Ulrich et al. | |
| 6,402,627 | B1 | 6/2002 | Gordon | |
| 7,182,694 | B2 * | 2/2007 | Ochi | G09F 19/02 472/29 |
| 8,684,852 | B1 | 4/2014 | Henry et al. | |
| 8,870,668 | B2 | 10/2014 | Keller et al. | |

(Continued)

FOREIGN PATENT DOCUMENTS

WO 2009051722 A1 4/2009

OTHER PUBLICATIONS

Notification of Transmittal of the International Search Report and the Written Opinion of the International Searching Authority, or the Declaration, dated Mar. 13, 2017.

*Primary Examiner* — Kien Nguyen
(74) *Attorney, Agent, or Firm* — Katherine M. Scholz; Kelly, Holt & Christenson, PLLC

(57) ABSTRACT

A rotating playground device is presented. The rotating playground device comprises a frame configured to rotate, wherein rotation is initiated by a force applied to the frame. The rotating playground device also comprises a braking system configured to limit a speed at which the frame rotates. The rotating playground device is permanently mounted within a playground environment, wherein permanently mounted comprises a frame mounting point coupled to a ground point.

20 Claims, 10 Drawing Sheets

(56) References Cited

U.S. PATENT DOCUMENTS

| | | | |
|---|---|---|---|
| 9,220,988 | B2 | 12/2015 | Keller et al. |
| 2013/0045810 | A1 | 2/2013 | Keller et al. |
| 2013/0090176 | A1 | 4/2013 | Ochi |
| 2013/0095935 | A1 | 4/2013 | Ochi |

* cited by examiner

ROTATING CLIMBING UNIT

CROSS-REFERENCE TO RELATED APPLICATIONS

The present application is based on and claims the benefit of U.S. Provisional Patent Application Ser. No. 62/265,559, filed Dec. 10, 2015, the content of which is hereby incorporated by reference in its entirety.

BACKGROUND

There are a wide variety of available playground devices. Some playground devices operate by spinning in a circular motion. Some examples include round-abouts, carousels, tire swings, and rotating rope swings. Rotating playground devices are designed to rotate based on an application of force, for example by a user pushing off the ground, or a nearby structure or by another individual providing a push or pull.

SUMMARY

A rotating playground device is presented. The rotating playground device comprises a frame configured to rotate, wherein rotation is initiated by a force applied to the frame. The rotating playground device also comprises a braking system configured to limit a speed at which the frame rotates. The rotating playground device is permanently mounted within a playground environment, wherein permanently mounted comprises a frame mounting point coupled to a ground point.

DETAILED DESCRIPTION OF ILLUSTRATIVE EMBODIMENTS

Playground and recreational devices present many design challenges. For example, playground climbing structures need to offer safe and engaging play for children, who may not be supervised during play. Play structures also need to be engineered such that a child falling from the structure will not get significant injury, as it is an object of playground design to encourage children to try new things, which presents the risk of an occasional fail.

Rotating playground devices present additional safety concerns, including both the speed at which the structure rotates, as well as the ability to prevent users from hanging on, or jumping off, the structure and causing self-injury. Other rotating devices have allowed user to climb on the device, but do not enclose the structure in order to prevent falls or injuries, or users being thrown from a device operating at high speeds. In one example, many classically configured roundabouts (also known as "Merry-Go-Rounds") allow unrestricted rotation with little or no enclosing structure, which can make many parents, guardians, and some child users uncomfortable with using the device. These concerns even deter some from playing on the device, which is an issue commonly exacerbated for small children.

Figure 1:
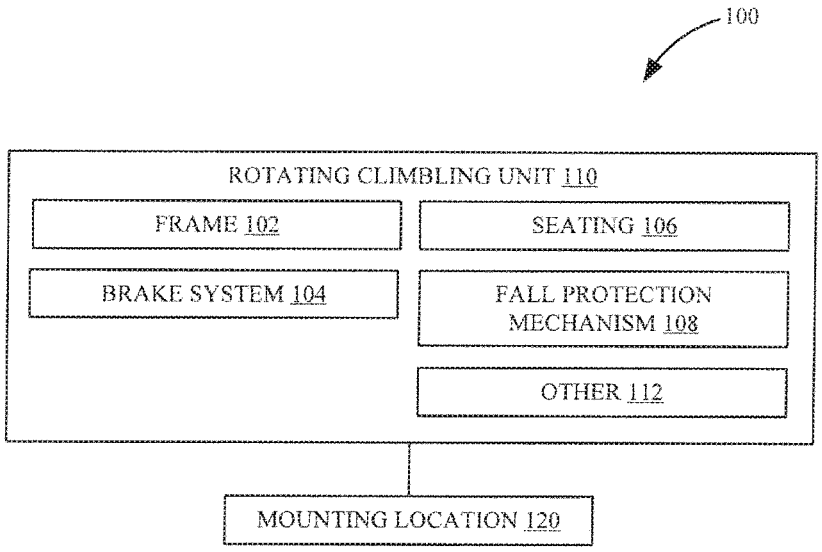
FIG. 1 illustrates a rotating climbing unit in a playground environment in accordance with an embodiment of the present invention.

FIG. 1 illustrates a rotating climbing unit in a playground environment in accordance with one embodiment of the present invention. Playground environment 100 includes a rotating climbing unit 110, in one embodiment. While rotating climbing unit 110 may be the only structure described with respect to recreational environment 100, in other embodiments rotating climbing unit 110 is one of many different play structures available within a single playground or park area. Rotating climbing unit 110, in one embodiment, is coupled to the ground of playground environment 100 at a mounting location 120. Mounting location 120 may comprise at least a protective surface such that a child falling from rotating climbing unit 110 does not suffer significant injury. Mounting location 120, in one embodiment, is substantially permanent. In one example, rotating climbing unit 110 is coupled to a concrete footing below ground level, such that once installed, rotating climbing unit 110 is substantially irremovable.

Figure 2:
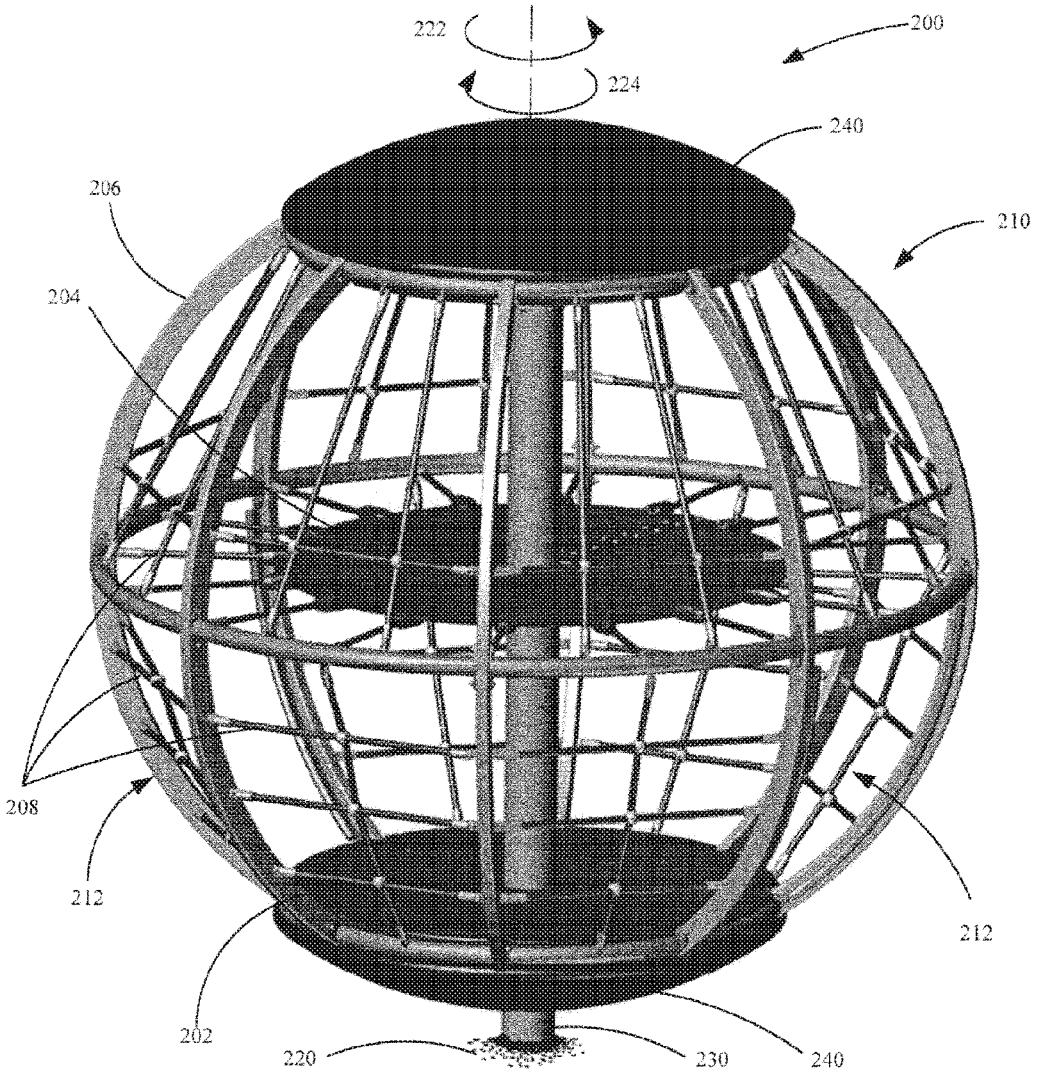
FIG. 2 illustrates a spherical rotating climbing unit in accordance with an embodiment of the present invention.

Rotating climbing unit 110 comprises a frame 102. Frame 102, in one embodiment, is coupled mounting location 120. Frame 102, in one embodiment, comprises a structure configured to keep a user from falling off of the rotating climbing device 110, or otherwise provide some structure for a user to hold onto. Frame 102 may also allow for rotating climbing unit 110, when actuated, to spin either in a clockwise or counter clockwise position. In at least one embodiment, rotating climbing unit 110 is configured to spin in both of a counter clockwise and a clockwise position. However, in one embodiment, rotating climbing unit 110 is limited to rotation in one of a clockwise or counter clockwise position. In one embodiment, for example as shown in FIG. 2, frame 102 comprises a semi-enclosed structure configured to allow a user access to internal seating areas, but configured to provide some protection against a child falling out of an inside of rotating climbing unit 110. In some embodiments, frame 102 comprises a plurality of frame members. In one embodiment, frame members comprise a stiff material, such as plastic or metal, configured to support a user hanging on an outside of frame 102. Frame 102 may also be configured to translate a force applied, for example by a parent or user standing outside the structure.

In one embodiment, rotating climbing unit 110 comprises a seating structure 106. Seating structure 106, in one embodiment, comprises an area where a user can either sit, stand, or otherwise position themselves on the rotating climbing unit in order to enjoy the ride. In one embodiment, this may comprise hanging from a frame 102. However, because hanging from frame 102 may be unsafe, seating structure 106 may comprise a designated area for a user to sit during interaction with rotating climbing unit 110. For example, seating 106 may comprise a floor of the rotating climbing unit configured for supporting a user. However, in another embodiment, seating 106 comprises a formed indentation. Seating structure 106 may comprise a rigid structure, in one embodiment. In another embodiment, seating structure 106 may comprise a semi-flexible structure, such as a rubber mat, a foam, etc.

Rotating climbing unit 110, in one embodiment, comprises a fall protection limit mechanism 108. In one embodiment, the fall protection mechanism 108 comprises netting, or another feature built into, or used in conjunction with frame 102. Fall protection mechanism 108, in one embodiment, is configured to keep a user within the confines of rotating climbing unit 10 during movement. Rotating climbing unit 110 may have other features 112 as well.

Rotating climbing unit 110 comprises a braking system 104. The braking system may be similar to that described in U.S. Pat. No. 8,870,668, issued Oct. 28, 2014, entitled INCLUSIVE ROTATING PLAY DEVICE, the contents of which are hereby incorporated by reference in their entirety. However, in some embodiments, braking system 104 comprises a progressive braking system.

In one embodiment, rotating climbing unit 110 may be actuated by a user providing an initial force pushing, for example, by pushing or pulling frame 102 in a clockwise or counter clockwise position. In one embodiment, brake system 104 is configured to ensure that rotating climbing unit 110 does not go fast enough to cause a user to be thrown from the device, or so fast that a child falling off of, or out of, the device is severely injured in one embodiment, brake system 104 comprises a progressive braking system, configured to apply a brake force that increases as rotating climbing unit 110 increases speed, ensuring that the rotating climbing unit 110 does not achieve speeds that could threaten the safety of a user. Brake system 104, in one embodiment, increase a brake force proportionally with an increasing speed of rotating climbing unit 110. In one embodiment, brake system 104 is configured to ensure that rotating climbing unit 110 does not surpass a maximum speed.

In at least some embodiments, rotating climbing unit 110 does not include safety restraint devices such as seatbelts. Additionally, in embodiments where restraints are present, it may still be difficult to ensure that users use included restraint devices correctly. Therefore, it is important that brake system 104 ensure that rotating climbing unit 110 does not achieve speeds sufficient to throw a child from the device, which could cause injury. However, it is important that brake system 104 also not actuate too quickly, so that rotating climbing unit 110 can achieve sufficient speed for a user to be entertained. Additionally, it is desired that users of all ages be able to actuate rotating climbing unit 110, such that even small forces, for example applied by another child, cause rotating climbing unit 110 to move. Therefore, in some embodiments, brake system 104 comprises a progressive braking system which allows for rotating climbing unit 110 to easily actuate for low speeds, and applies progressively more braking force as the rotating climbing unit 110 achieves higher speeds.

In one embodiment, rotating climbing unit 110 is a powerless device configured to rotate only upon application of an external force. Brake system 104, in one embodiment, is also a powerless device configured to automatically apply a brake force as rotating climbing unit 110 increases speed.

FIG. 2 illustrates a spherical rotating climbing unit in accordance with one embodiment of the present invention. Rotating climbing units can come in all shapes and sizes. In one embodiment, a rotating climbing unit comprises a sphere-shaped structure, with one or more seating areas, such as that shown in FIG. 2. However, other shapes and configurations could be used, for example cube-shaped structures, rectangular-shaped structures, or other structures. Additionally, while FIG. 2 illustrates a unit sized to fit two distinct seating areas 202 and 204, a smaller structure may be sized to fit only one seating area.

FIG. 2 illustrates a playground environment 200 comprising a rotating climbing; unit 210 coupled to ground 220 at a mount location 230. Ground 220, in one embodiment, comprises a protective surfacing. Protective surfacing 220 may comprise at least some artificial surfacing that is softer than concrete, such that a user falling off of rotating climbing unit 210 has some of the force of the fall absorbed by protective surfacing 220.

In one embodiment, rotating climbing unit 210 comprises a seating area 202 substantially accessible at ground level. In one embodiment, the height of seating 202 is configured such that users of all ages and sizes are able to access the inside of the rotating climbing unit 210. In one embodiment, for example, a handicapped user, for example in a wheelchair, may easily be able to transition themselves from their wheelchair to seating area 202. In one embodiment, rotating climbing unit 210 is large enough that it comprises additional seating, for example in an upper portion of the structure 204.

Rotating climbing unit 210 comprises a frame 206 which may comprise multiple ribs, for example, evenly spaced about a perimeter of the rotating climbing unit 210. In one embodiment, frame 206 comprises eight ribs located about a circumference of the rotating climbing unit 210. However, frame 206 could comprise more, or fewer, rib components for example 10 rib components, or only 6 rib components, or only 4 components. Additionally, rib components of frame 206 may be spaced irregularly, or only semi-regularly, about the perimeter in one embodiment. However, while a spherical rotating climbing unit 210 with eight ribs is illustrated, other shapes and configurations are also envisioned herein.

Rotating climbing, unit 210 comprises an enclosure mechanism 208, in one embodiment. Enclosure mechanisms 208, in one embodiment, serve to keep a user within the confines of rotating climbing unit 210, making it more difficult for a user to accidentally fall out of, or off of, rotating climbing unit 210. At different points about rotating climbing unit 210, there may be one or more entry points 212. Entry point 212 may, in one embodiment, comprise an area of rotating climbing unit 210 with no, or a reduced number of, enclosure mechanisms 208. Entry point 212 may allow a user to easily access the inside of rotating climbing unit 210. While entry points 212 are only shown in FIG. 2 on a bottom half of rotating climbing unit 210, and other embodiments, or access points may be located anywhere on the surface area of the structure. However, in at least some embodiments, it is desired for a user to only be able to enter rotating climbing unit 210 at ground level, in order to reduce the likelihood that a user falls off of rotating climbing unit 210, for example out of an entry point 212 located on the top half of the structure.

In at least some embodiments, rotating climbing unit 210 comprises a progressive braking system (not shown in FIG. 2). However, the braking system, in one embodiment, is covered in order to protect it from damage due to weather, tampering. In one embodiment, the braking system is covered such that a user is not injured by interacting with the braking system. In some embodiments, one or more covers 240 are provided in order to enclose, for example a braking system and/or mounting fixtures between rotating climbing unit 210 and ground 220 at mount location 230.

Figure 3A:
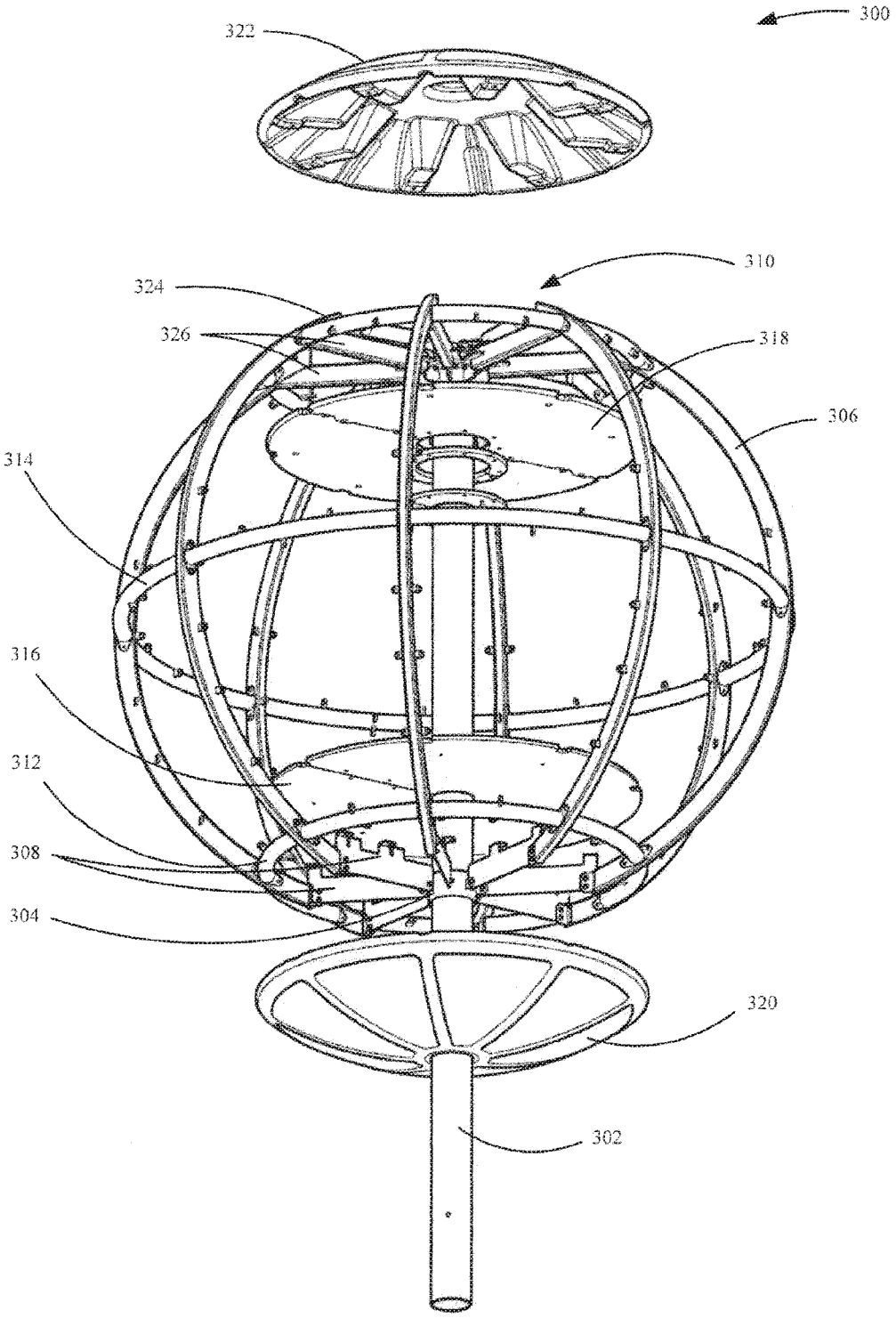
FIGS. 3A and 3B illustrate exploded views of a rotating climbing unit in accordance with an embodiment of the present invention.
Figure 3B:
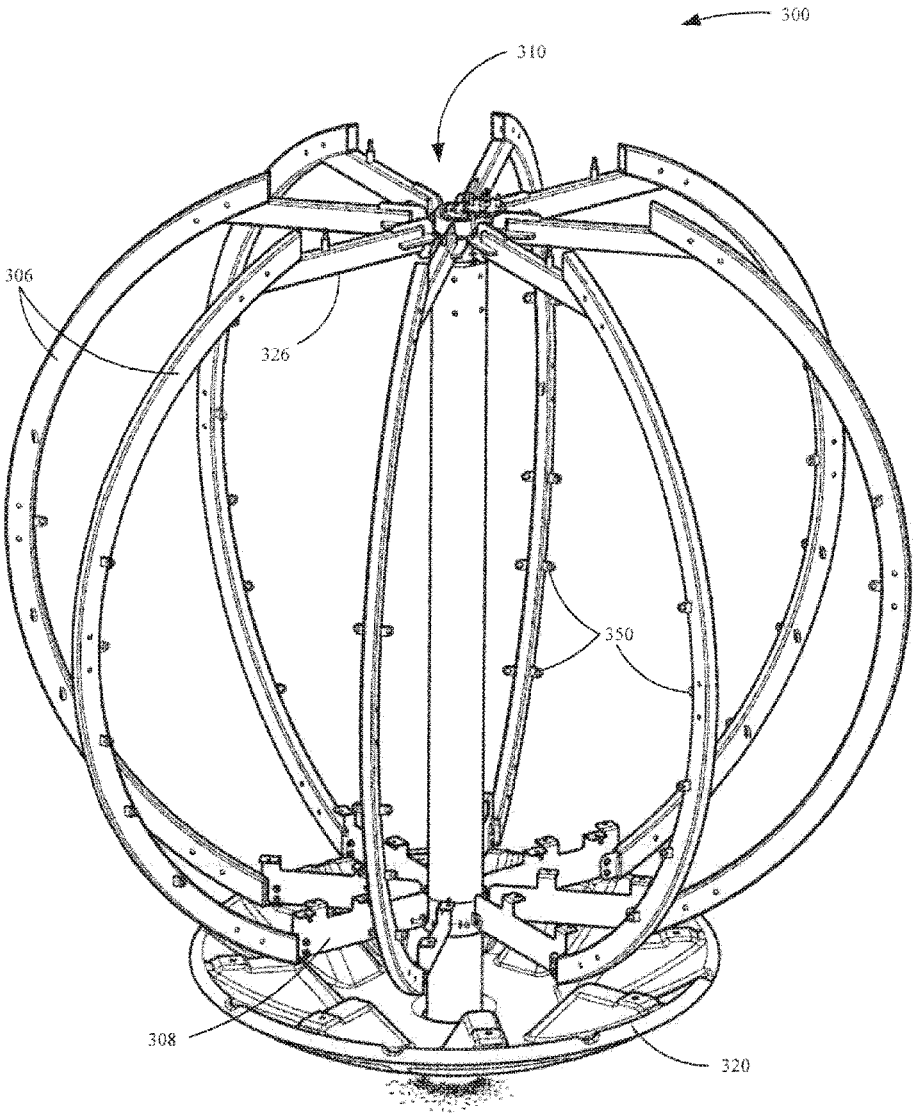

FIGS. 3A and 3B illustrate exploded views of a rotating climbing unit in accordance with an embodiment of the present invention. A recreational environment may comprise one or more rotational climbing units 300, in one embodiment, as well as other playground devices.

Rotating climbing unit 300, in one embodiment, comprises a center post 302 configured for installation at a ground location, in accordance with one embodiment. Center post 302 may, in one embodiment, provide arm installation coupling point for other features of rotating climbing unit 300. In one embodiment, center post 302 couples to a mounting position 304 at a first end, and a brake system 310, at a second end, such that brake system 310 is substantially opposite the ground location.

Mount 304 may, in one embodiment, couple to one or more frame portions 306 distributed about a perimeter of rotating climbing unit 300. As illustrated in FIG. 3A, in one embodiment, a frame coupling portion 308 may couple one or more frame portions 306 to mount position 304. In one embodiment, frame portion 306 and frame mount coupling portion 308 are manufactured as a single component. However, in another embodiment, they are manufactured separately, as illustrated in FIG. 3A. In some embodiments, rotating climbing unit 300 also comprises internal structural reinforcements. For example, in one embodiment, a center support 304 couples to frame coupling portions 308, which, in turn, couple to mount support 312. In one embodiment, mount support 312 comprises one or more coupling positions for a seating area 316. In one embodiment, a center support 314 comprises one or more coupling portions which may receive, or be coupled to, frame portions 306. Center support 314 may also be configured, in one embodiment, to couple to an internal, elevated seating area, as shown in FIG. 2, for example, one embodiment, frame portions 306 also couple to, on an opposing side of rotating climbing unit 300 from a frame coupling portion 308, a brake coupling portion 320.

In at least some embodiments, if mount coupling portions 308, and brake coupling portions 326 are accessible to a user, a risk of a user's fingers or other appendages getting caught in various mechanisms increases. Therefore, it may be advantageous to close off these areas from access by a user. Additionally, the movement and braking mechanisms may be at risk for damage due to weather or theft concerns. Therefore, in at least one embodiment, covers 320 and 322 are provided, and coupled to a seating portion 316 and an internal cover 318, in one embodiment, in order to ensure that these areas are protected from user interference and/or other risk factors.

FIG. 3B illustrates a second partially exploded view of a rotating climbing unit 300, showing braking system 310 in greater detail, with internal cover 318 removed for clarity. In one embodiment, braking system 310 differs from the resistance mechanism of U.S. Pat. No. 8,870,660 in that braking system 310 comprises a progressive braking system, configured to provide an increasing resistance force as the speed of rotating climbing unit 300 increases.

In one embodiment, frame portions 306 have one or more coupling points 350. Coupling points 350 may be configured, in one embodiment, to receive a fall limiting mechanism—such as rope or netting, for example. Coupling points 350 may also be configured to receive stabilization portions configured to be positioned substantially perpendicular to frame portions 306, such as center support 314.

FIGS. 4A-4D illustrate internal seating for a rotating climbing unit in accordance with one embodiment of the present invention. In some embodiments, a rotating climbing unit 400 is configured with an internal seating area 410. Internal seating area 410 may, in one embodiment, be substantially enclosed within frame portions 402 of rotating climbing unit 400. Internal seating area 410 may be large enough, in one embodiment, to accommodate multiple users within rotating climbing unit 400.

Figure 4A:
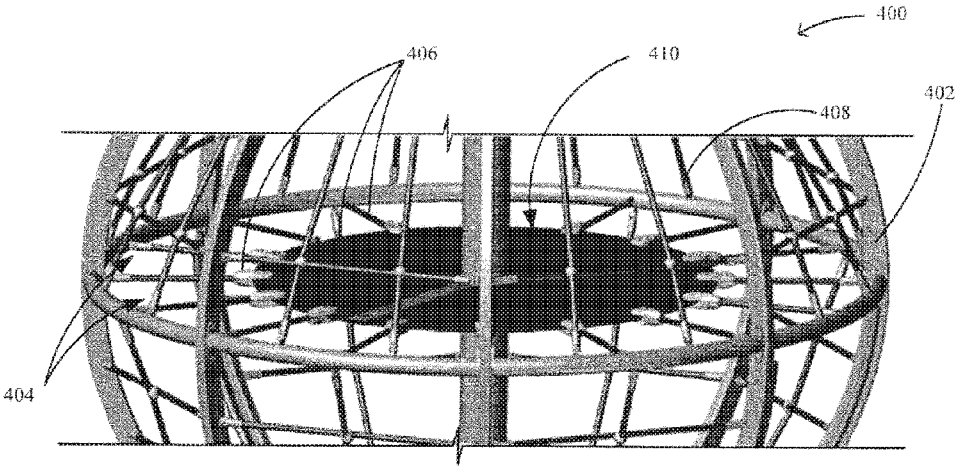
FIGS. 4A-4D illustrate internal seating for a rotating climbing unit in accordance with one embodiment of the present invention.
Figure 4B:
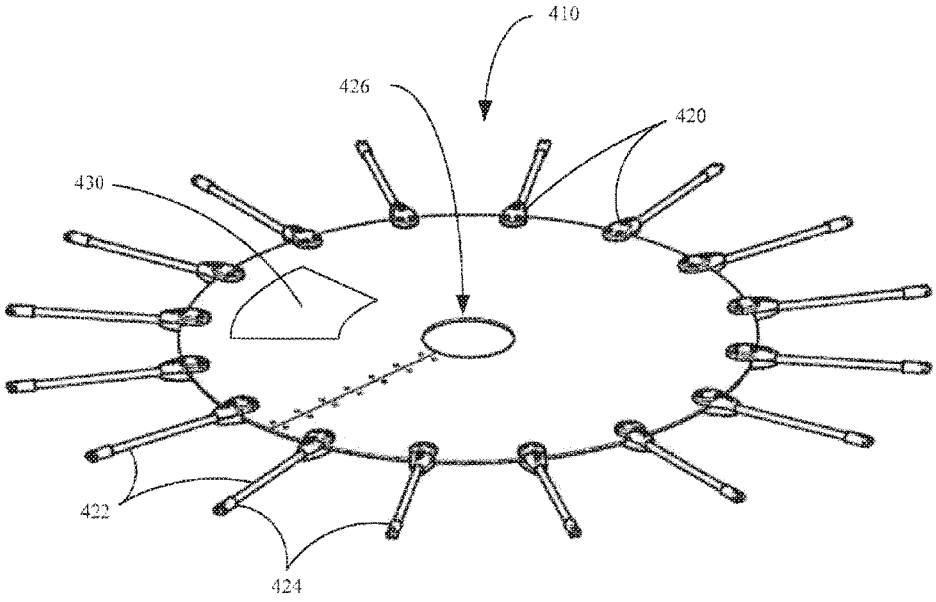

FIG. 4A illustrates an installed internal seating configuration 410 within a rotating climbing unit 400. In one embodiment, seating 410 is coupled to one or more frame portions 402, by one or more coupling mechanisms 404. In one embodiment, each coupling mechanism 404 couples to seating area 410 at a coupling point 406, and couples to a frame portion 402 at a coupling point 408.

FIG. 4A illustrates a seating area 410 with no internal access points. This may be advantageous in some scenarios, as it limits an user's ability to accidentally fall. However, in one embodiment, for example that shown in FIG. 4B, seating area 410 may comprise an internal access point 430. In some embodiments, internal access point 430 may allow for a user to easily move between a lower and an upper seating area.

In one embodiment, seating area 410 comprises an aperture 426 configured to receive a center pole of rotating climbing unit 400. However, in other embodiments, seating area 410 comprises no aperture, but couples to a top portion and bottom portion of center pole 410. In a further embodiment, rotating climbing unit 400 is constructed such that no center pole is required.

In one embodiment, seating 410 is coupled to frame portions by one or more coupling mechanisms 404. In one embodiment, coupling mechanism 404 comprises a coupler 422 coupled to a frame connection point 424, on a first end, and a platform coupling portion 420 on a second end. Coupler 422, in one embodiment, comprises a belt cable. In another embodiment, coupler 422 comprises a rod. In another embodiment, coupler 422 comprises tubing, for example metal, plastic, or rubber tubing. In another embodiment, coupler 422 comprises rope.

Figure 4C:
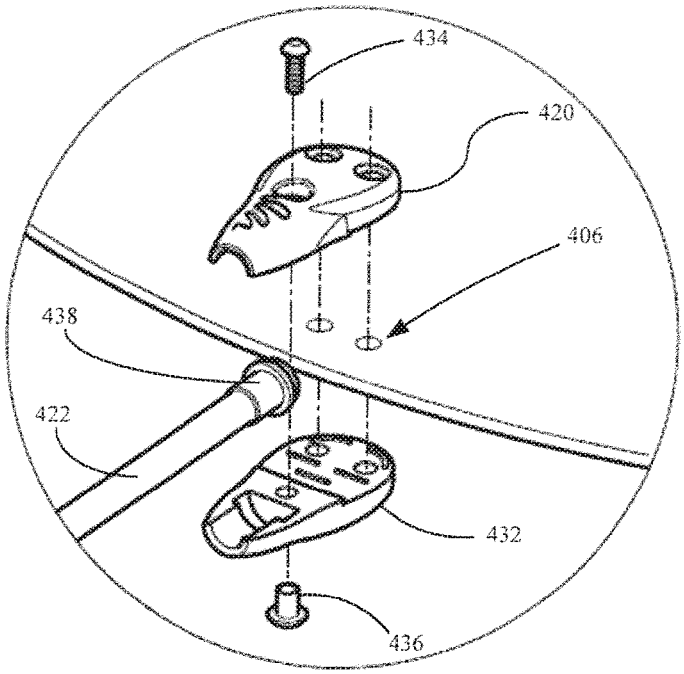

FIG. 4C illustrates a closer view of one embodiment of a platform coupling mechanism 420. In one embodiment, platform coupling mechanism 420 couples to a platform 410 at a coupling point 406. In one embodiment, coupling comprises one or more pins 434 received by a flange nut 436. In another embodiment, coupling comprising nuts and bolts, welding, or any other suitable attachment mechanism. In one embodiment, coupling mechanism 422 is configured to fit within, and be received by platform coupling mechanism 420, for example using a coupling portion 438. Coupling portion 438 may be shaped such that it is received by platform coupling mechanism 420, for example as shown in FIG. 4C.

Figure 4D:
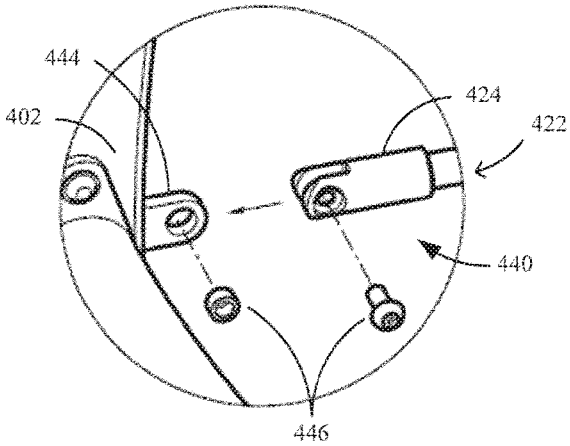

FIG. 4D illustrates one embodiment of a frame coupling mechanism. In one embodiment, coupler 422 comprises a frame coupling mechanism 424 which is configured to be received by frame portion 402 at a flame receiving point 444. In one embodiment, a frame coupling mechanism 446 comprises a bushing coupled to a bolt. However, in other embodiments, other suitable coupling mechanisms can be used.

Figure 5:
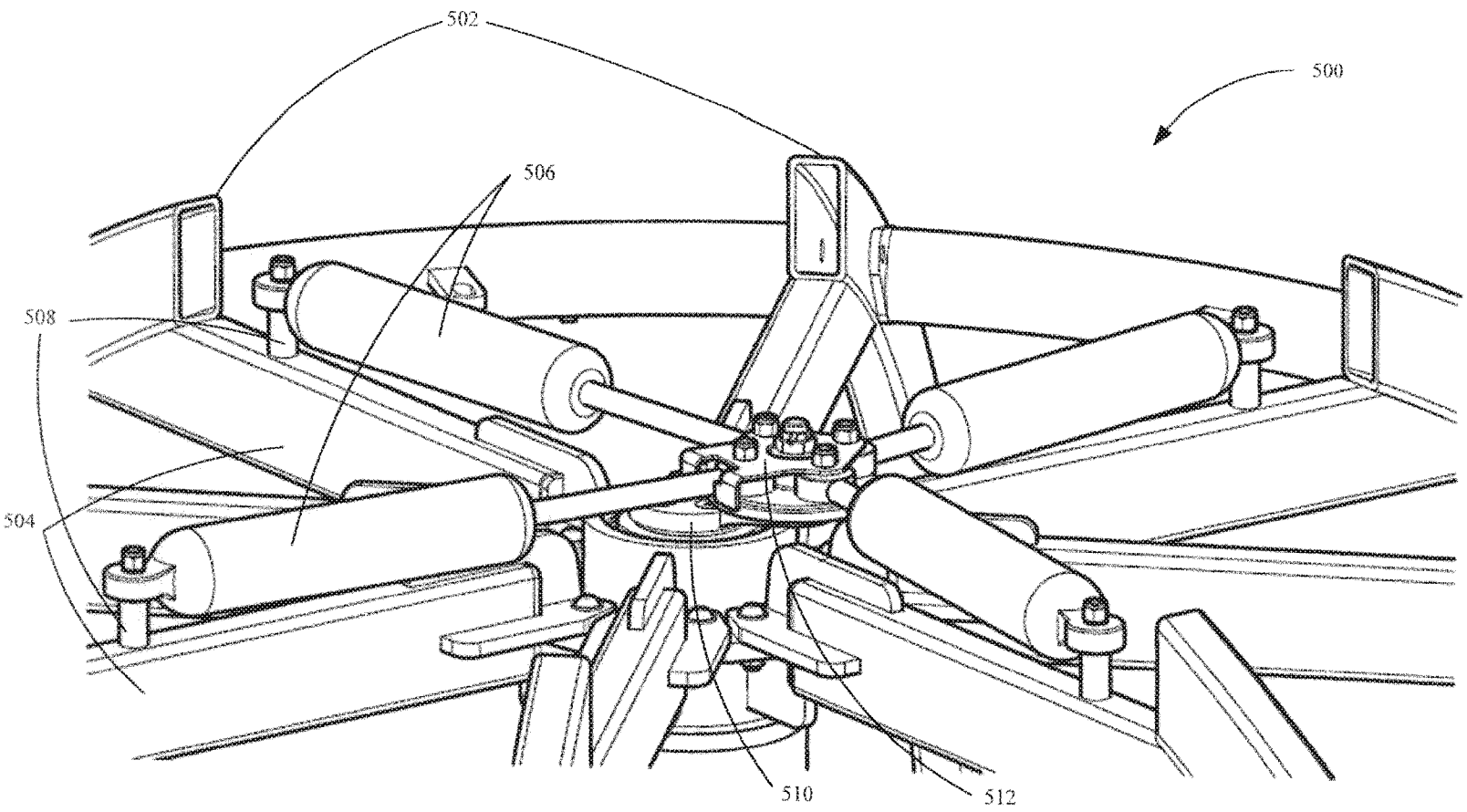
FIG. 5 illustrates a close-up view of a brake assembly for a rotating climbing unit in accordance with one embodiment of the present invention.

FIG. 5 illustrates a close-up view of a brake assembly for a rotating climbing unit in accordance with one embodiment of the present invention. As indicated in FIGS. 2 and 3, in one embodiment, a brake system 500 is located on an opposing end of a rotating climbing unit from a ground mount point. In one embodiment, a center of the braking system 512 is offset from a hub 510 where one or more frame connecting portions 504 meet, for example in the center of a rotating climbing unit. In one embodiment, a brake system comprises a plurality of cylinders 506. As illustrated in FIG. 5, in one embodiment, four cylinders 506 comprise braking system 500. In one embodiment, cylinders 506 are spaced such that they alternate between frame connection portions 504. However, in other embodiments, additional cylinders 506 or fewer cylinders 506 may be used, and they may be arranged in any suitable mechanism. In one embodiment, the brake system illustrated in FIG. 5 is a progressive braking system configured to apply an increasing amount of brake force as the speed of the rotating climbing unit increases, such that the rotating climbing unit will reach, and not surpass, a maximum operating speed.

Figure 6A:
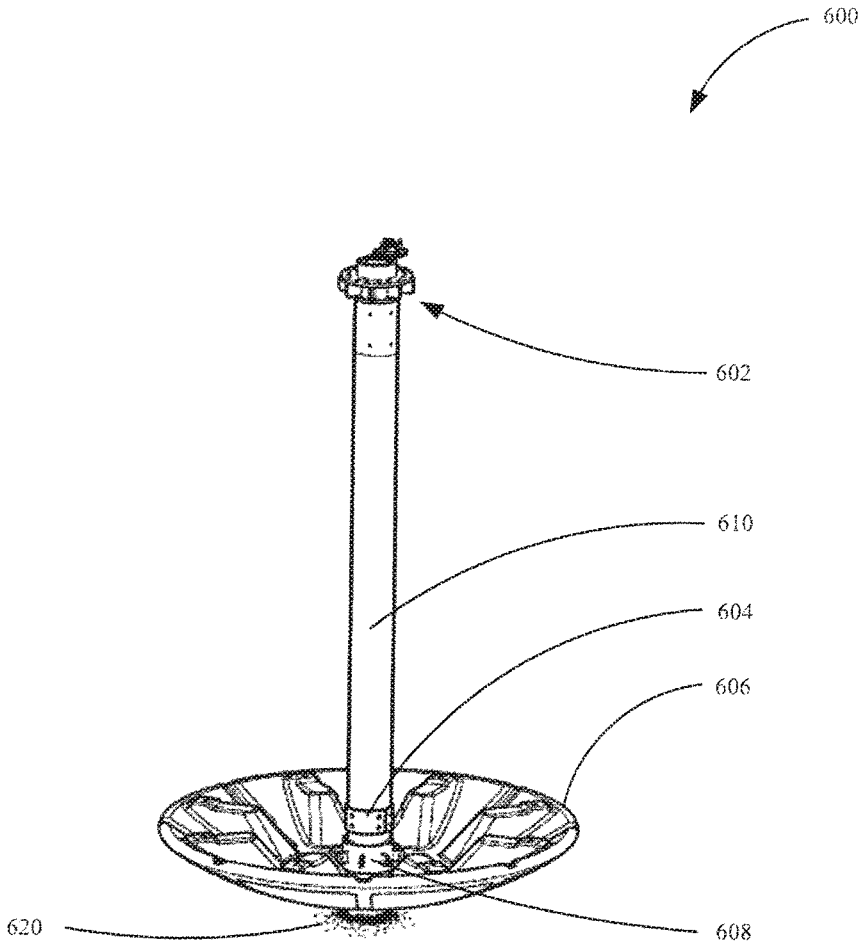
FIGS. 6A and 6B illustrate example mounting configurations for a rotating climbing unit base in accordance with an embodiment of the present invention.
Figure 6B:
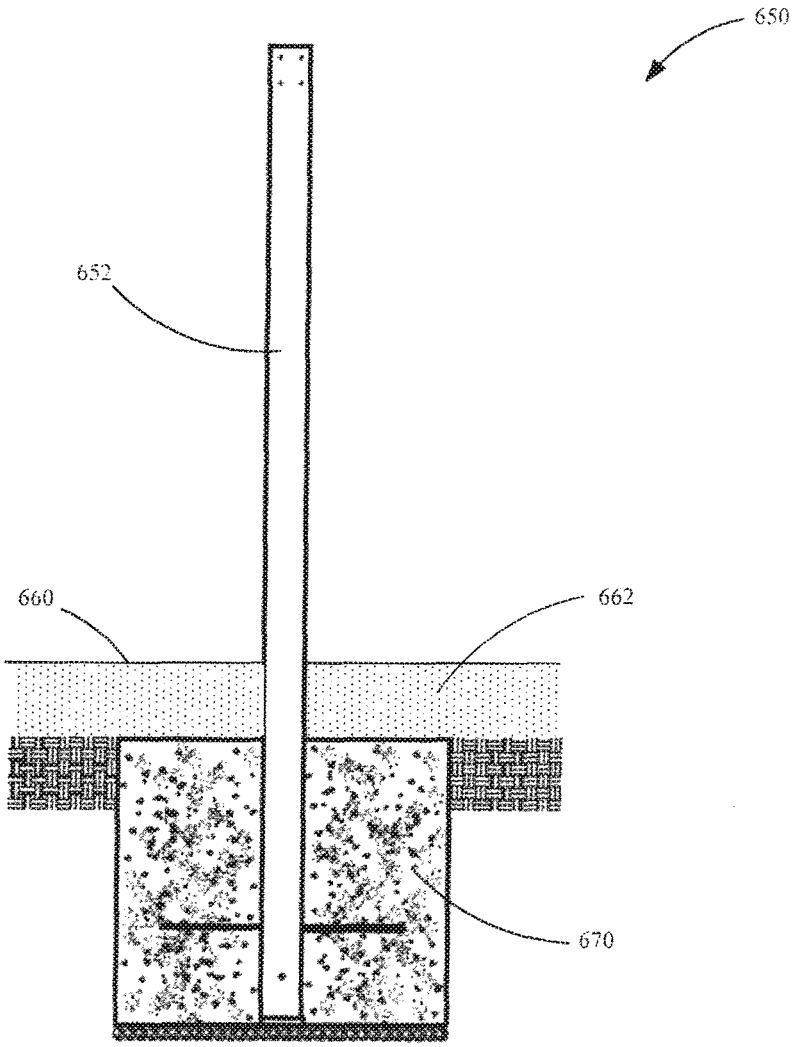

FIGS. 6A and 6B illustrate example mounting configurations for a rotating climbing unit base in accordance with one embodiment of the present invention. FIG. 6A illustrates a rotating climbing unit base 600 mounted at a ground location 620. In one embodiment, rotating climbing unit base 600 comprises a center post 610 coupled, on one end, to a mount 608 and, on a second end, coupled to a hub assembly 602. In one embodiment, the hub assembly 602 is configured to couple to frame portions as well as to cylinders of a progressive braking assembly. In one embodiment, mount 608 is configured to couple to frame portions, such that frame portions when coupled at both hub assembly 602 and mount 608 define an outer structure of a rotating climbing unit.

FIG. 6B illustrates one example embodiment of a direct bury configuration for a mounting location 650. In one embodiment, mounting configuration 600 comprises a center post 652 mounted to a point below ground 660. Center post 652, in one embodiment, is buried within a concrete block 670, for stability. Between concrete 670 and ground 660, in one embodiment, is a layer of protective surfacing. For example, in one embodiment, a layer of protective surfacing is provided to reduce the physical impacts of a fall from a rotating climbing unit.

Figure 7:
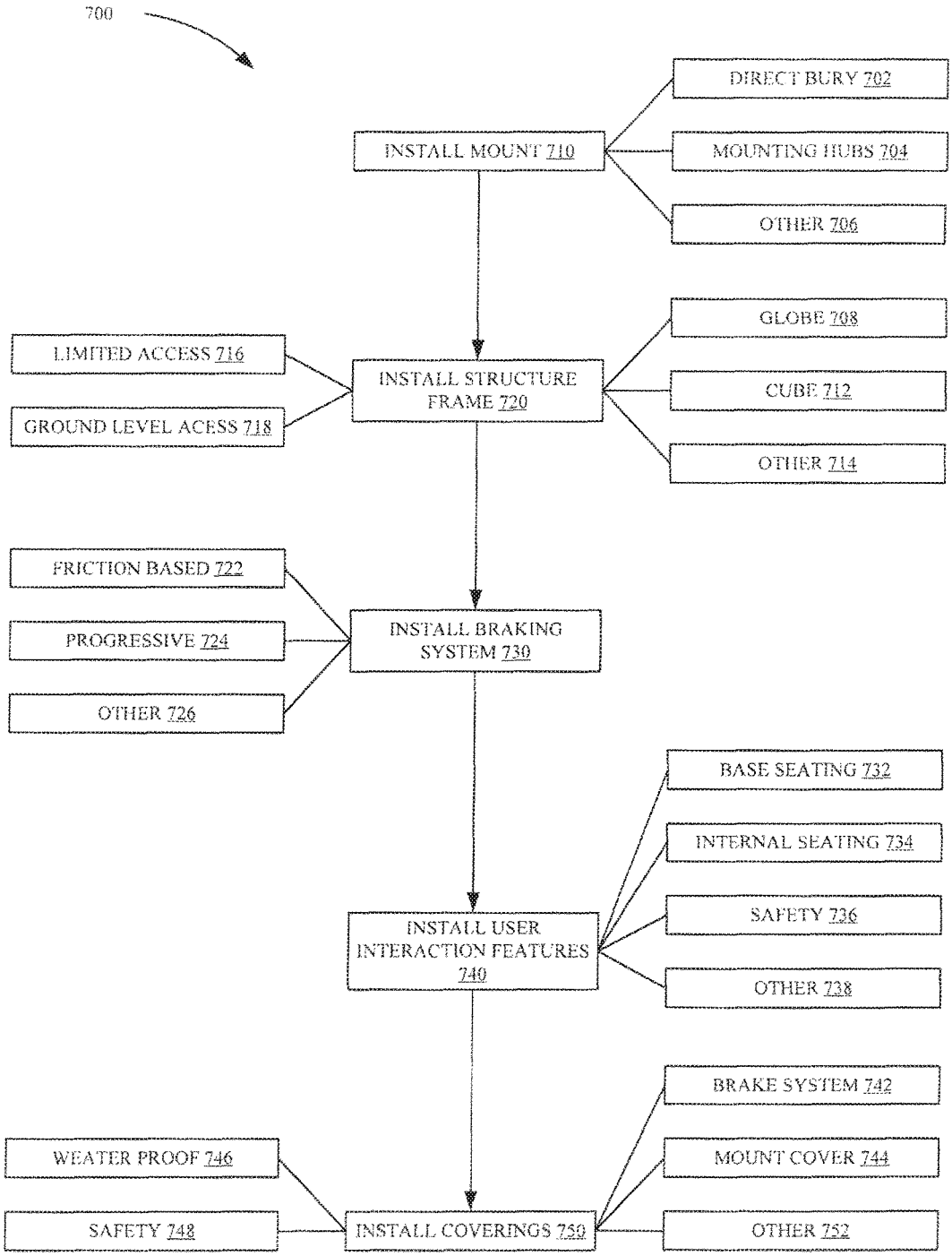
FIG. 7 illustrates a flow diagram of one method of installing a rotational climbing unit accordance with one embodiment of the present invention.

FIG. 7 illustrates a flow diagram of one method of installing a rotational climbing unit in accordance with one embodiment of the present invention. Method 700 may be useful to install any of the rotational climbing units described herein, or rotational climbing units of other shapes, or including other additional features. For example, as described herein, a rotational climbing unit may be spherical in shape and may be sized such that it has multiple seating areas to accommodate multiple users. However, smaller rotational climbing units may only accommodate one user, only have one seating area, etc. Additionally, while rotational climbing units described herein have been described as comprising an enclosed frame, in other embodiments at least part of the rotational climbing unit is open.

At block 710, a mount is installed. In one embodiment, installing a mount comprises using a direct bury method permanently install a mount within a playground environment. In one embodiment, a direct bury method, as indicated in block 702, comprises digging and laying a footing underneath ground level. In one embodiment, a post, for example a central post as described above, is placed within the footing hole. In one embodiment, the footing is a concrete footing. In one embodiment, installing a mount also comprises installing mounting hubs as indicated in block 704. A mounting hub assembly may be useful attach frame elements to a mount location. For example, in an embodiment where a rotating climbing unit includes a center post, mounting hubs are attached above ground at a bottom and a top location, and configured to receive frame components. Installing a mount may also comprise other attributes, as indicated in block 706. For example, bushings may be attached in one embodiment.

In block 720 the structural frame is installed. In one embodiment, a structural frame is shaped such that the rotating climbing unit will resemble a globe, as indicated in block 708. However, other structural frames are also envisioned for example a structural frame may also result in a cube-shaped rotational climbing unit, as indicated by block 712. However other structural designs may also be used, as indicated in block 714. For example, a structural frame may be used that comprises a half structure, for example a bowl, such that a top of the rotational climbing unit is exposed. Additionally, other shapes may also be used, for example within an ovular cross-sectional area, a triangular cross-sectional area, or any other appropriate shape.

In one embodiment, installing a structural frame comprises installing one or more frame components to a mounting hub assembly. Installing the structural frame, as indicated in block 720, may also comprise installing a frame such that limited access is provided, as indicated in block 716. It may be desired to limit access onto the rotational climbing unit by users to only a few locations. Therefore, limiting access, as indicated in block 716, may comprise doors, netting, or other restrictions such that users can only enter and leave the rotating climbing unit at specific points. This may discourage child users from misusing the rotational climbing unit, or injury. In one embodiment, the structural frame may be configured such that only ground level access is available, as indicated in block 718.

At block 730 a braking system is installed. The braking system may be a friction-based braking system, as indicated in block 722, configured to engage as rotation begins. In another embodiment, the braking system is a progressive braking system, as indicated in block 724. Other braking systems may also be used, as indicated in block 726.

A progressive braking system may be beneficial for rotational climbing units in playground areas that smaller children may access. It is desired that any user be able to engage rotational movement of the rotating climbing unit. Therefore, a progressive braking system, that outputs a very small braking force at very low speeds, may be desirable such that small users that can push off from the ground, or otherwise apply a smaller initial force, and successfully cause motion of the rotating climbing unit.

In one embodiment, the braking system comprises a series of cylinders coupled to a brake mount hub. Installing a braking system, in block 730, in one embodiment, comprises installing one or more cylinders to a hub clamp. In one embodiment, the hub clamp is offset from a center of the rotational climbing unit. In one embodiment, the braking system comprises four cylinders. However, in other embodiments other numbers of cylinders may be used, for example 2, 6, 8 or any other suitable number.

At block 740 user interaction features are installed. The rotating climbing unit, in one embodiment, is configured to be used by users of all abilities. Therefore, it is important that a user of any ability is accommodated. Therefore, installing a user interaction feature may comprise installing base level seating, as indicated in block 732. Base level seating, in one embodiment, is configured such that it is above ground, but low enough that users of different abilities can access it. Therefore, in one embodiment, base level seating comprises seating at such an elevation that a user in a wheelchair have access. Additionally, base level seating may comprise seating low enough to the ground that a smaller child can access the rotating climbing unit without help. Installing user interaction features may also comprise installing internal seating, as indicated in block 734.

As described above, some embodiments of rotating climbing units are sized such that multiple seating areas are included. In one embodiment, a belt platform and belt cables extend within an interior of the rotating climbing unit and are accessible by a user. The internal seating may be accessible, in one embodiment, from a user at the base seating level. In another embodiment, the internal seating is accessible by a user climbing an exterior of the rotating climbing unit. User interaction features may also comprise safety features such as netting, as indicated in block 736. Such safety features may discourage a user from climbing on an exterior of the frame, in one embodiment. Safety features may also comprise rope, fencing, or any other suitable safety features. Additionally, in one embodiment, safety features comprise seatbelts, or other engaging features configured to assist a user in maintaining their position during rotation of the rotating climbing unit. Other features 738 may also be included, in other embodiments.

In block 750 coverings are installed. In one embodiment, coverings are installed to protect mechanical mechanisms of the rotating climbing unit from weather and other outdoor elements, as indicated in block 746. However, coverings may also be installed to protect users from injury, as indicated in block 748. For example, a user may be injured when interacting with braking system while the rotating climbing unit is operational.

In one embodiment, installing coverings comprises covering a brake system, as indicated in block 742, such that it is not accessible from an interior or an exterior of the rotating climbing unit by causal users. However, the brake system may be accessible by repair crews using special tools. In one embodiment, installing coverings comprises installing a mount cover, as indicated in block 744, such that the mounting position is not accessible by a user from an interior or exterior of the rotating climbing unit. Other coverings, as indicated in block 752 may also be used. For example, in one embodiment, the ground is covered with a protective surfacing prior to a user engaging the rotating climbing unit. A protective surfacing may be useful in conjunction with a rotating climbing unit such that a user who falls from the rotating climbing unit, while the device is in motion or stationary, does not suffer significant injury.

Although the present invention has been described with reference to preferred embodiments, workers skilled in the art will recognize that changes may be made in form and detail without departing from the spirit and scope of the invention.

What is claimed is:

1. A rotating playground device for installation within a playground environment comprising:

a frame configured to rotate about a rotation axis, wherein rotation is initiated by a force applied to the frame, wherein the frame comprises a substantially flat seating structure configured to rotate about the rotation axis;

a braking system configured to limit a speed at which the frame rotates about the rotation axis, wherein the braking system is a progressive braking system configured to apply an increasing break force as the frame rotates about the rotation axis at increasing speeds; and wherein the rotating playground device is permanently mounted at a mounting location within the playground environment, wherein permanently mounted comprises a frame mounting point coupled to a below-ground point at the mounting location.

2. The rotating playground device of claim 1, wherein the progressive braking system is configured to provide, at a first speed, a first brake force, and, at a second speed, a second brake force.

3. The rotating playground device of claim 2, wherein the first speed is faster than the second speed, and wherein the first brake force is greater than the second brake force.

4. The rotating playground device of claim 1, wherein the braking system is positioned substantially opposite the frame mounting point.

5. The rotating playground device of claim 1, wherein the permanently mounted comprises the frame mounting point coupled to a concrete footing.

6. The rotating playground device of claim 1, and further wherein the seating structure is substantially enclosed within the frame.

7. The rotating playground device of claim 6, and further comprising a second seating structure, wherein the seating structure is positioned at a first elevation, and the second seating structure is positioned at a second elevation, wherein the second elevation is higher than the first elevation.

8. The rotating playground device of claim 1, and further comprising a fall protection mechanism.

9. The rotating playground device of claim 8, wherein the fall protection mechanism comprises rope extending between a first frame component and a second frame component.

10. The rotating playground device of claim 8, wherein the frame is substantially spherical.

11. A rotating climbing unit configured for installation within a playground environment, the rotating climbing unit comprising:

a frame comprising a plurality of frame components, the frame being configured to rotate about a rotation axis when a force is applied to the frame;

a substantially flat seating area, configured to accommodate a user, configured to rotate about the rotation axis, the substantially flat seating area being located within the frame;

a mounting location within the playground environment, wherein the rotating climbing unit is mounted at the mounting location, wherein permanently mounted comprises a frame mounting point coupled to a below-ground point at the mounting location;

a mechanical propulsion system configured to translate a force applied to the frame into rotational motion of the rotating climbing unit, wherein rotational motion comprises the rotating climbing unit rotating about a central axis; and wherein the mechanical propulsion system is configured to apply a brake force that increases with an increasing speed of the rotating climbing unit.

12. The rotating climbing unit of claim 11, wherein a fall protection mechanism extends between a first frame component and a second frame component.

13. The rotating climbing unit of claim 11, and further comprising:

a central post, coupled to the frame, wherein the central post comprises the central axis.

14. The rotating climbing unit of claim 11, wherein the seating area is a first seating area, and wherein the rotating climbing unit also comprises a second seating area.

15. The rotating climbing unit of claim 14, wherein the second seating area is at a different elevation from the first seating area.

16. The rotating climbing unit of claim 11, wherein the seating area is configured to accommodate multiple users, and wherein the seating area is substantially enclosed by the frame.

17. A rotating playground unit comprising:

a mounting point configured to couple to a permanent installation point within a playground environment, wherein the rotating playground unit is permanently mounted at the mounting point;

a frame configured to couple to the mounting point, the frame being configured to rotate about a rotation axis in response to an applied force, wherein the frame comprises a substantially flat seating structure configured to rotate about the rotation axis; and a progressive brake system, coupled to the frame, configured to apply a mechanical brake force, wherein the mechanical brake force is configured to limit a rotational speed of the spherically-shaped rotating playground unit, and wherein the mechanical brake force is configured to increase with respect to the rotational speed; and wherein permanently mounted comprises a frame mounting point coupled to a below-ground point at the mounting location.

18. The rotating playground unit of claim 17, wherein the frame comprises a stiff material.

19. The rotating playground unit of claim 18, wherein the frame comprises a plurality of ribs configured to, when coupled, form the spherically-shaped rotating playground unit.

20. The rotating climbing unit of claim 19, wherein the frame is configured to enclose a seating area configured to house a user.

* * * * *